US007981820B2

(12) United States Patent
Westerkamp et al.

(10) Patent No.: US 7,981,820 B2
(45) **Date of Patent: *Jul. 19, 2011**

(54) PRESS FABRIC FOR A MACHINE FOR THE PRODUCTION OF WEB MATERIAL AND METHOD TO PRODUCE SAID PRESS FABRIC

(75) Inventors: Arved Westerkamp, Dettingen/Erms (DE); Robert Crook, Wilson, NC (US); Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 179 days.

This patent is subject to a terminal disclaimer.

(21) Appl. No.: 12/339,554

(22) Filed: Dec. 19, 2008

(65) Prior Publication Data

US 2010/0159760 A1 Jun. 24, 2010

Related U.S. Application Data

(60) Provisional application No. 61/015,804, filed on Dec. 21, 2007.

(51) Int. Cl.
*B32B 27/20* (2006.01)
*B32B 5/16* (2006.01)

(52) U.S. Cl. ..... 442/72; 442/64; 442/71; 442/74; 162/306

(58) Field of Classification Search ..... 442/64, 442/71, 72, 74; 162/306
See application file for complete search history.

(56) References Cited

U.S. PATENT DOCUMENTS

| | | | | |
|---|---|---|---|---|
| 4,439,481 | A | 3/1984 | Johnson et al. | |
| 4,781,967 | A * | 11/1988 | Legge et al. | 428/109 |
| 5,232,768 | A * | 8/1993 | Eklund et al. | 442/225 |
| 6,712,940 | B2 * | 3/2004 | Crook | 162/306 |
| 2005/0124248 | A1 | 6/2005 | Hyvonen | |
| 2005/0181694 | A1 * | 8/2005 | Crook et al. | 442/270 |
| 2006/0016545 | A1 * | 1/2006 | Hansen | 156/148 |
| 2006/0130992 | A1 * | 6/2006 | Ouchi et al. | 162/358.1 |
| 2007/0003760 | A1 * | 1/2007 | Crook et al. | 428/375 |
| 2010/0155008 | A1 * | 6/2010 | Ragvald et al. | 162/348 |

* cited by examiner

*Primary Examiner* — Norca L Torres-Velazquez
(74) *Attorney, Agent, or Firm* — Taylor IP

(57) ABSTRACT

A press fabric for a machine for the production of web material, especially paper or cardboard, includes a carrying structure and at least one layer of fibrous material on one web material contact side of the carrying structure, whereby at least some of the fibers of the at least one layer of fibrous material are coated at least partially with a film of a first polymeric material and whereby a permeable composite structure is formed by a second polymeric material in the at least one fibrous layer, in that the hollow spaces which are formed between fibers of the at least one fibrous layer are filled partially with the second polymeric material.

26 Claims, 5 Drawing Sheets

PRESS FABRIC FOR A MACHINE FOR THE PRODUCTION OF WEB MATERIAL AND METHOD TO PRODUCE SAID PRESS FABRIC

CROSS REFERENCE TO RELATED APPLICATIONS

This is a non-provisional application based upon U.S. provisional patent application Ser. No. 61/015,804, entitled "COMPOSITE PRESS FABRIC III", filed Dec. 21, 2007, which is incorporated herein by reference.

BACKGROUND OF THE INVENTION

1. Field of the Invention

The present invention relates to a press fabric for a machine for the production of web material, specifically paper or cardboard, and to a method to produce said press fabric.

2. Description of the Related Art

The continuous press fabrics utilized, for example, in press sections in paper machines, move together with the web material which is to be manufactured through one or several press nips where, for example, the press fabric and the web material that is to be produced run between them is being compressed on the one hand, and liquid being squeezed from it on the other hand. This squeezed out liquid is to be removed by, or through, the press fabric. For this to occur, it is necessary to provide this press fabric with a porous structure, or structure with hollow spaces, suitable for absorption of the liquid. A structure of this type, however, is also subject to press loads occurring in the area of a press nip. Therefore, there is the danger of material fatigue due to the constant compression and relaxation, or the porosity and, thereby, the available hollow spaces, could be greatly reduced over the duration of the operation.

What is needed in the art is a press fabric for a machine for the production of web material, especially paper or cardboard, and a method to produce said press fabric with which improved liquid removal properties and a greater stability under load can be achieved.

SUMMARY OF THE INVENTION

The present invention provides a press fabric, especially a press felt, for a machine for the production of web material, especially paper or cardboard, including a carrying structure and at least one layer of fibrous material, whereby at least some of the fibers of the at least one layer of fibrous material are coated at least partially with a first polymeric material, which forms a film and, whereby a fluid-permeable composite structure is formed by a second polymeric material and fibers of the at least one fibrous layer in that the second polymeric material only partially fills and/or bridges the hollow spaces which are formed between these fibers.

In other words, in the at least one layer of fibrous material at least part of the fibers are coated at least partially with a film of a first polymeric material. In addition, a permeable composite structure is formed by a second polymeric material and fibers of the fibrous layer, wherein the second polymeric material partially fills and/or bridges the hollow spaces that are formed between fibers of the at least one fibrous layer. A formation composed of the second polymeric material is hereby provided whose embodiment may be at least partially continuous, or preferably completely continuous, and irregular. Fibers of the fibrous layer are at least partially embedded into the polymeric formation.

Effects generated by the two polymeric materials concur in the press fabric of the present invention. On the one hand, the fibers, or at least part of the fibers, are coated with a first polymeric material forming a film, thereby supporting or stiffening their structure. This coating can cause a cross linkage of the individual fibers with each other so that when, considering the elastic properties of the polymeric material intended for the coating, an improved rebound characteristic can be combined with decreased material fatigue. The continuing presence of the second polymeric material, which forms a permeable composite structure with the layer of fibrous material, and which fills and/or bridges hollow spaces between the fibers of the at least one fibrous layer, allows a targeted adjustment of the water retention and removal property of this layer.

It must be noted in this connection that the second polymeric material itself is not porous or permeable, for example, foamed, however, a permeable composite structure is formed by the only partial bridging and/or filling of the hollow spaces between the fibers.

At least some of the fibers of the at least one fibrous layer are bonded with each other at fiber cross points and/or fiber contact points through the first polymeric material that forms the film. A continuous mesh of interlaced fibers is formed by the bonding of the fibers of the layer. This fibrous mesh contributes considerably to the elasticity characteristics and the rebound properties of the at least one layer of fibrous material.

In addition, the permeable composite structure, including the second polymeric material, includes partially connected three-dimensional and/or two-dimensional formations, which are arranged irregularly in the at least one layer of fibrous material. The second polymeric material may form a single component, or in other words, a completely connected and permeable polymeric layer in the at least one layer of fibrous material. The polymeric layer is hereby especially elastically compressible. Depending upon the specific application, the polymeric layer may extend across the width of the layer of fibrous material, or only across a part of the width of the layer of fibrous material. The polymeric layer extends, however, along the entire length of the press fabric.

A single component polymeric layer is to be understood to be a polymeric layer which is formed from a single continuous component. In order to provide permeability, openings extend though the polymeric layer, whereby the openings in the polymeric layer are formed in that the polymeric material, which forms the polymeric layer, fills and/or bridges the hollow spaces between the fibers of the fibrous layer only partially. To verify that the permeable polymeric layer is indeed a single component, the fibrous material—if it is, for example, polyamide—can be dissolved, for example, with formic acid.

An embodiment of the present invention provides that the second polymeric material which fills and/or bridges the hollow spaces between fibers at least partially, if not completely, is deposited on sections of the fibers which are coated with the first polymeric material which forms the film. In this instance, the first polymeric material forming the film additionally serves as a bonding agent between the second polymeric material and the fibers of the at least one fibrous layer.

The first polymeric material and the second polymeric material respectively include an elastomer polymer. The first and the second polymeric material may be an elastomer polymer. The second polymeric material, alone or in combination, includes for example, a thermoplastic elastomer, especially a thermoplastic elastomer polyurethane, a polyether mass polyamide, or a polyamide (PA), for example, of types PA 11, PA 12, PA 6.10 or PA 6.12. The second polymeric material may be one of the aforementioned materials.

As will be addressed later, the first polymeric material may, for example, be applied in the form of an aqueous dispersion of particle shaped first polymeric material into the at least one layer of fibrous material. Such aqueous dispersions are known, for example, under the name "witcobond polymer dispersion" and are marketed, for example, by Baxenden Chemicals Ltd., England.

The first polymeric material, with which the fibers are coated, may have a higher melting point than the second polymeric material. This permits a second polymeric material, which forms a permeable composite structure, to be added after the fibers are already coated with the first polymeric material, without impairing the coating of the fibers through the heating necessary for melting of the base material for the second polymeric material, providing a permeable composite structure. The film, consisting of the first polymeric material which coats at least sections of the fibers, may have a thickness in the range of 1 μm to 20 μm. The film formed by the first polymeric material may have a uniform thickness.

At least some of the fibers of the at least one layer of fibrous material may be coated with several film layers of the first polymeric layers. It is feasible in this context that at least some of the several film layers have different characteristics when compared to each other. These different characteristics can, for example, result from differences in the first polymeric materials which are used for the respective film layers. One embodiment of the present invention may provide one outer fibrous layer onto which the first and the second polymeric material is applied, which provides a web material contact side of the press fabric. The first and the second polymeric material may have different elastic properties when compared with each other.

Beginning at the web material contact side, the first polymeric material which coats the fibers of the at least one fibrous layer can generally extend to a depth of 10% to 100%, to a depth of 30% to 100%, or to a depth of 50% to 100%, relative to the overall thickness of the press fabric. Bonding of the second polymeric material, which is furnished into the layer, can be provided with complete penetration of the first polymeric material through the thickness of the fibrous layer, independent of whether the second polymeric material is arranged on the entire thickness of the layer or only locally in a limited thickness range in the layer of fibrous material.

An additional embodiment of the present invention provides that, beginning at the web material contact side, the second polymeric material, which bridges and/or fills hollow spaces between fibers of the at least one fibrous layer, extends to a depth of 10% to 50% or to a depth of 10% to 30% relative to the total thickness of the press fabric. In this instance, the second polymeric material, which partially fills the hollow spaces between the fibers of the at least one fibrous layer, does not extend over the entire thickness of the fibrous layer, but is essentially located in the area of the web material contact side. The second polymeric material, which fills the hollow spaces and which is located in the area of the web material contact side, provides large local surface elements. The result is that, when the inventive press fabric runs through a press nip, lower local pressure differentials are produced on the web material contact side than on an uncoated fibrous layer representing the web material contact side. This has a positive effect upon a uniform and mark-free dewatering of the web in the press nip. In the aforementioned context, for example 80% of the second polymeric material which bridges and/or fills the hollow spaces between the fibers of the at least one fibrous layer, may be arranged over 80% of the thickness or, for example, 40% of the thickness of the press fabric.

According to an additional aspect of the present invention, a method is provided for the manufacture of a press fabric used in the production of web material, including the following the steps:

a) Provision of at least one layer of fibrous material, b) At least partial coating of at least some of the fibers of the at least one layer of fibrous material with a film of a first polymeric material, c) Formation of a fluid permeable composite structure from a second polymeric material and fibers of the at least one fibrous layer, by the second polymeric material only partially filling and/or bridging hollow spaces which form between fibers (26).

The step c) may be implemented so that the second polymeric material at least partially, possibly completely, adheres to the sections of the fibers which are already coated with the first polymeric material. For example, after fusing of the second polymeric material its adhesion on the fibers is considerably improved because of the utilization of the first polymeric material which forms a film on the fibers. This leads to an extended durability of the product performance on the paper machine. In addition to the function of stiffening the layer of fibrous material, the first polymeric material also improves the adhesion of the second polymeric material on the fibers.

In order to interconnect the fibers of the at least one fibrous layer, thereby creating a network of fibers, one embodiment of the present invention provides that under the step b) at least some of the fibers of the at least one fibrous layer are bonded through the first polymeric material at fiber cross points and/or fiber contact points. The step b) may include adding an aqueous dispersion of particulate, or fine particulate, first polymeric material into the at least one layer of fibrous material, as well as the removal of liquid from the dispersion added into the at least one fibrous layer. This means that the film coating the fibers of the at least one fibrous layer is formed essentially, or completely, in that liquid is removed from the particulate polymeric dispersion and the polymeric particles adhere to the fibers in the form of a film.

In an additional process step, the topography of the surface can then be influenced so that it assumes an embodiment. This includes a smoothing process of the web material contact side, for example, by means of calendering. Therefore, an additional embodiment of the inventive method provides that subsequent to the step c) the web material contact side of the press fabric is processed, for example, smoothed and/or compressed, in an additional step by use of pressure and/or temperature.

The present invention also provides that, subsequent to the step c), the at least one layer of fibrous material is compressed with the first and the second polymeric material in an additional step by utilizing pressure and/or temperature. This achieves a pre-compacting of this layer.

For example, at least 50% of the particles of this fine particulate first polymeric material have a size in the range of 2.0 nm to 10 μm. In this context it is also feasible that all particles of the fine particulate first polymeric material have a size of 10 μm maximum, or of 2 μm maximum. Size of a particle is to be understood generally as being its maximum spatial dimension in one direction, in other words length or width or height.

In order to be able to influence the characteristics of the fibers of the fibrous layer, one embodiment of the present invention provides that the step b) is implemented several times to provide a multi-layered or multiple film coating the fibers of the at least one layer of fibrous material. In order to influence the stability of the thereby coated fibers it can be provided that the fibers of the at least one fibrous layer are coated with different first polymeric material in at least two implementations of the step b).

The method of the present provides that the step c) includes adding the second polymeric material in particle form, which may be in an aqueous dispersion, into the at least one layer of fibrous material, as well as, fusing the second polymeric material in particle form furnished into the at least one fibrous layer. In this instance, the permeable composite structure, which includes the second polymeric material, is formed in that the second polymeric material is melted subsequently to its being furnished into the at least one layer of fibrous material, is deposited onto the fibers and in that the melted second polymeric material subsequently cures while adhering to the fibers. In this instance too, liquid can, for example, be removed from the at least one layer of fibrous material prior to melting of the particle shaped second polymeric material.

The first and the second particle shaped polymeric material may include an elastomer. The first and the second particle shaped polymeric material may be an elastomer. The elastomer may be, for example, polyurethane. The first polymeric material in particle form can have a smaller particle size than the second polymeric material in particle form.

In order to ensure that, when melting the particulate second polymeric material, in order to create the permeable composite structure, the fiber coating is not impaired, the particle shaped first polymeric material used under the step b) may have a higher melting point than the particle shaped second polymeric material used under the step c).

The application capacity of the second polymeric material may be affected if 50 volume % of the total volume of all particles of the second polymeric material (average value d50) have a particle size between 20 μm and 150 μm, for example, between 50 μm and 100 μm.

The step a) can include securing, or needling of, the at least one layer of fibrous material on a carrying structure. It is feasible in this context that the bonding of the at least one layer of fibrous material with the carrying structure occurs prior to the application of the first and second polymeric material. Alternatively, the first and the second polymeric material may be applied first into the at least one layer of fibrous material, prior to its bonding with the carrying structure.

The carrying structure may be woven or randomly laid. It is feasible in this context that the carrying structure include a single component polymeric screen structure or is in the embodiment of same. Generally, any flat textile structure is feasible that would be able to function as a load-bearing carrying structure. In addition, the at least one layer of fibrous material can be in the embodiment of a non-woven layer.

The step c) can be implemented subsequent to the step b). This means that the fibers are first coated with the polymeric material provided, for example, through application of a film-forming polymer dispersion and subsequent drying or removal of the liquid medium. The application of the second polymeric material, which may be particle-shaped, occurs only afterwards. If the process is controlled so that the second polymeric material adheres on areas of the fibers which are already coated with a film of the first polymeric material, a bonding of the second polymeric material with the fibers that are already coated with a polymeric film occurs due to a drying and melting process, thereby creating a permeable, highly elastic composite structure for the transportation of the web in the web-producing machine. Alternatively it is also possible to implement the steps b) and c) simultaneously.

The current invention is described below in detail, with reference to the enclosed drawings:

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 1:
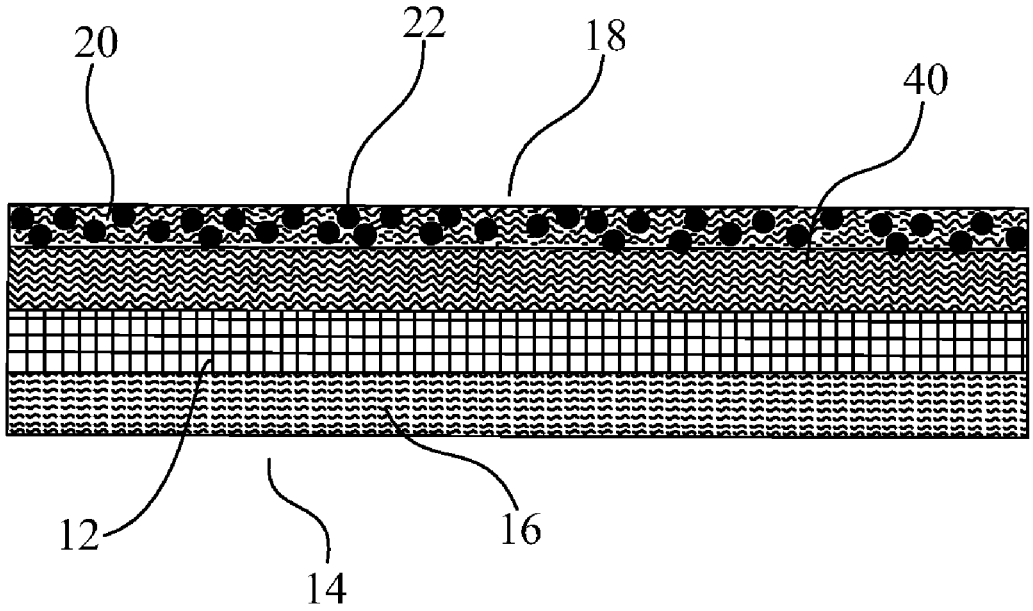
FIG. 1 illustrates a schematic sectional side view of the press fabric of the present invention; shown in an intermediate production phase.

Corresponding reference characters indicate corresponding parts throughout the several views. The exemplification(s) set out herein illustrate(s) (one) embodiment(s) of the invention (, in one form,) and such exemplification(s) (is)(are) not to be construed as limiting the scope of the invention in any manner.

DETAILED DESCRIPTION OF THE INVENTION

Referring now to the drawings, and more particularly to FIG. 1 which illustrates a cross section of press fabric 10 as is used, for example, in a press section of a paper machine in an intermediate production phase. Press fabric 10 includes carrying structure 12 which may, for example, be in the embodiment of a woven fabric, a randomly laid fabric or a spiral link structure. On machine contact side 14 of carrying structure 12 layer 16 of fibrous material may be provided, which may be bonded with carrying structure 12, for example, through needling. In the illustrated example, layer 20 and layer 40 of fibrous material may be provided on web material contact side 18. These too are bonded rigidly with carrying structure 12, for example, through needling. The fibers of both layers 20 and 40 are coated with a first film-forming polymeric material. The first film-forming polymeric material may also coat layers 12 and 16 completely or partially.

To this end a plurality of fine particles 22 of the first polymeric material is applied onto layer 20. Particles 22 may distribute themselves on the entire thickness of layer 20 of fibrous material. To achieve this, an aqueous dispersion of fine-particulate first polymeric material 22 with a weight component of approximately 2 to 10% of particles 22 is applied into layer 20 from the direction of web material contact side 18.

Subsequently, the liquid is removed, for example, by means of evaporation from layers 20, 40 and 16 of fibrous material, and also carrying structure 12, thereby creating a film which at least partially coats the fibers in this layer.

This method of adding a film-forming first polymeric material, the drying process and film-forming process, and consequently the coating and partial bonding or embedding of the fibers, can be repeated several times so that an accordingly multi-layered coating is created on the fibers. The materials utilized in this process can vary from film layer to film layer.

After the fibers of layer 20 of fibrous material are coated to the greatest extent with the first polymeric material, for example, elastic polyurethane material, a second particle-shaped polymeric material can be applied in an additional process step, whereby the particles are dimensioned, for example, so that at least 50% of the total volume of all particles have a size in the range of 20 μm to 120 μm. These particles too will distribute themselves in the interior volume area by adapting to the porosity of layer 20 of already coated fibrous material, whereby due to the fundamentally larger particles, the particles accumulate increasingly in the area near the surface, that is in the area of web material contact side 18. If necessary, smaller particles can penetrate deeper into the overall structure (layers 20, 12, 16).

Subsequent to this, a melting process occurs, whereby the now particle shaped second polymeric material is melted. Since the second polymeric material, which forms the permeable layer, has a lower melting point than the first polymeric material with which the fibers of layer 20 of fibrous material were coated, heating need only occur to a temperature which will melt the second particle shaped polymeric material, however, does not impair the first film-forming polymeric material of the fiber coating. This provides a strong bond between both materials. In a solidified state this provides a three-dimensional, permeable formation in the hollow spaces of layer 20 of fibrous material, whereby this permeable polymeric formation is present primarily in the area near the surface, that is in the area of material contact surface 18, thus being able to form a mat-type polymeric formation on the surface of layer 20 of fibrous material. It must be mentioned in this context that the porosity of the polymeric formation is basically not created through a porosity of the second polymeric material, but materializes in that the hollow spaces between fibers of the fibrous layer are only partially filled and/or bridged.

The proportion of this second polymeric material which forms a continuous polymeric formation may be, for example, in the range of 20 g/m$^2$ to 400 g/m$^2$. The tensile strength of the utilized second polymeric material is preferably in the range between 5 and 1000 Mpa and, this polymeric material should have a melting point in the range of between 120° C. and 220° C.

To provide the film from the first polymeric material, polymeric dispersions can be used, and may, for example, be based on polyurethane or polyacrylate but also others, or compounds of a plurality of polymer dispersions, for example, Impranil DLH or Witcobond 372-95, or any similar material with characteristics in comparable ranges. The tensile strength of the first polymeric materials created from the polymer dispersions may be in the range of 1 to 100 MPa, and the maximum elongation can be in the range of 100 to 1600%. The fine particulate first particle material may be applied in an amount, for example, in the range of 20 to 500 g/m$^2$. As already explained, these materials may be applied from the direction of the web material contact side, and may be in the form of an aqueous dispersion so that the particles can distribute themselves in the interior volume area of the layer of fibrous material. For this purpose, at least 50% of the particles of the first polymeric material should have a size in the range of approximately 2 nm to 10 μm.

Various thermoplastic polymeric materials, which may be elastic materials, for example, polyurethane can be used as a second polymeric material. These may be polyurethanes which are available under trade names Estane, Pearlcoat, Unex, etc. and which possess the desired material properties. Alternatively, polyether block polyamide (for example, Pebax by Arkema) or polyamide (PA), for example PA11, PA12, PA6, or PA12 which are available under the trade names Orgasol or Rilsan, or similar can also be used in combination with thermoplastic polyurethanes. Materials or material mixtures having a high fused mass may be utilized.

The second polymeric material is utilized, for example, in powder form and may be applied as an aqueous dispersion. In order to adjust the necessary viscosity and stability of the dispersion for a respective application process, disperging agents may also find use as thickening agents. The second polymeric material can also be applied dry, for example, by means of sprinkling it.

For the application of the first film-forming polymeric material a spraying process, splattering, slop-pad, etc. can be used for the application of the second polymeric material. The aforementioned methods, as well as thermal application methods, can be utilized for the application of the second polymeric material. Alternatively, the film-forming coating of the fibrous material is also feasible through means of polymer solutions.

The principles of the present invention may also be applied if several layers of fibrous material are utilized. It is also possible to implement the described the steps—that is coating of the fibers and formation of the permeable composite structure—in one operational process. To this end, a dispersion consisting of a mixture of a fine particulate dispersion of coarser particles, for example (D50=100 μm), of the second polymeric material may be applied in variable proportions. The coarser particles deposit themselves primarily on the surface of the fibers. A polymeric film forms on the fibers during the subsequent drying process, which additionally binds the coarser particles. Subsequently, a melting process occurs during which the coarser particles are melted. Since the second polymeric material, which forms the permeable layer, may have a lower melting point than the polymeric material with which the fibers of layer 20 of fibrous material were coated, heating need only occur to a temperature which will melt the second particle material, but which, however, does not impair the material of the fiber coating, leading to a strong bond between both materials. In a softened state, this provides a three-dimensional permeable formation in the hollow spaces of layer 20 of fibrous material.

Figure 2:
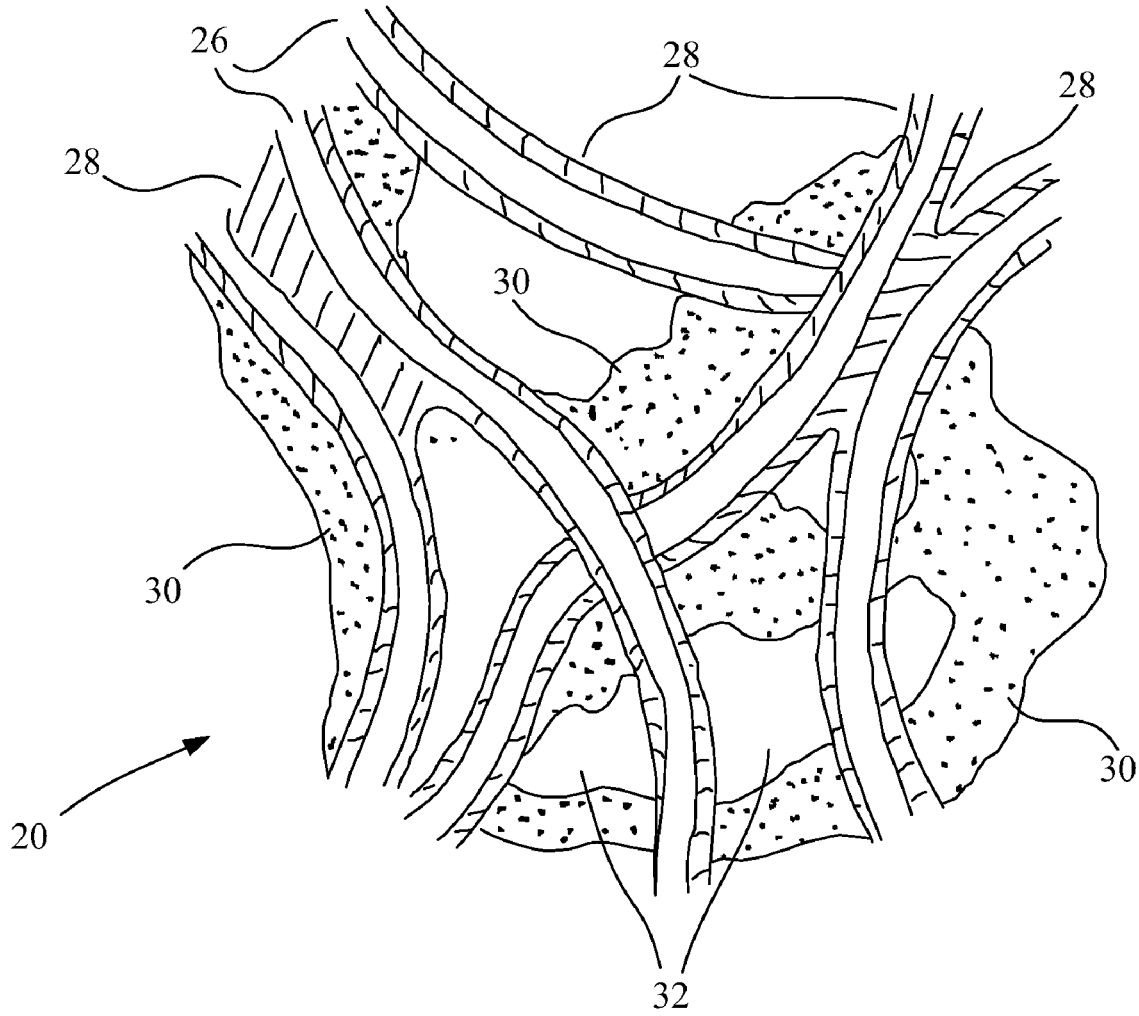
FIG. 2 illustrates an enlarged view of fibrous material with coated fibers and a permeable composite structure with polymeric material.

FIG. 2 further illustrates an enlarged schematic view of the fiber structure in layer 20 of fibrous material. Individual fibers 26 are recognized in FIG. 2, which are coated with film 28 of the first polymeric material. On the one hand fibers 26 are strengthened through film coating 28. On the other hand, a bonding is created through film 28 at the crossing points of fibers 26, so that the entire rigidity of layer 20 of fibrous material increases. In addition permeable polymeric formation 30 forming second polymeric material is seen, which primarily accumulates in the area of the crossing points, or in the vicinity of fibers 26 which are already coated with film 28 after it is melted and cooled. Pores or hollow spaces 32, which permit the liquid penetration through layer 20, are located between fibers 26 and polymeric material areas 28, 30.

Figure 3:
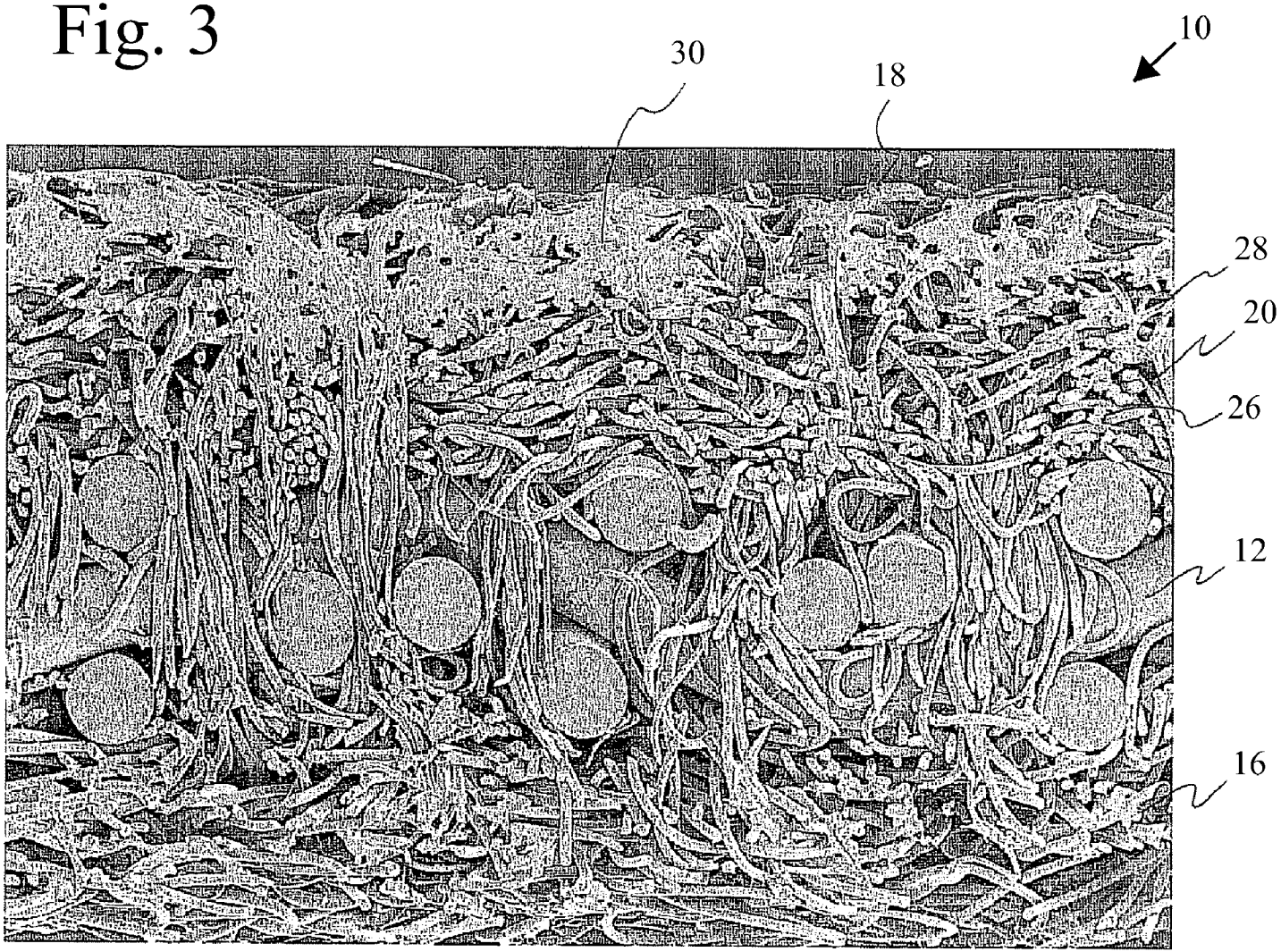
FIG. 3 illustrates a cross sectional electron-microscopical micrographie of the press felt of the present invention.

FIG. 3 illustrates a cross sectional electron-microscopical micrographic of press fabric 10 in the embodiment of a press felt. Press fabric 10 includes layer of fibrous material 20 containing fibers 26 which provides web material contact side 18. Machine contact side 14 of press fabric 10 is formed by a layer of fibrous material 16. Between the two layers of fibrous material 20 and 16 is carrying structure 12 in the form of woven fabric 12. Two layers of fibrous material 16 and 20, as well as woven fabric 12, are firmly bonded with each other by means of needling.

Fibers 26 of layer 20 are coated, possibly completely, with film 28 formed by the first polymeric material. In the area of web material contact side 18 of fibrous layer 20, a permeable composite structure is formed to a thickness of approximately 50% relative to the thickness of fibrous layer 26 from second polymeric material 30 and fibers 26 in that hollow spaces which are formed between fibers 26 of fibrous layer 20 are partially filled or bridged with the second polymeric material.

Figure 4:
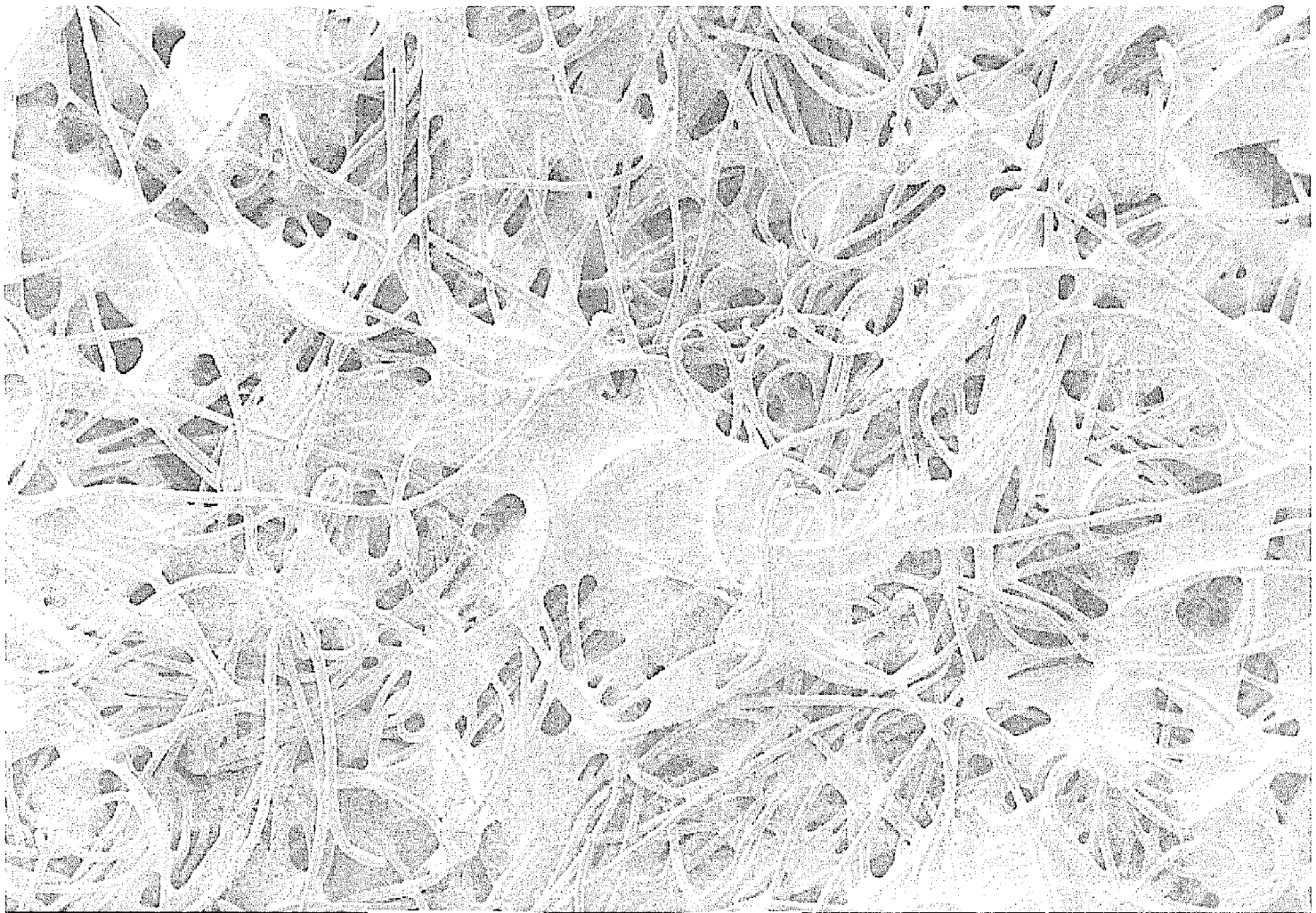
FIG. 4 illustrates an electron-microscopical micrographie of the web material contact side with a permeable composite structure, consisting of fibers and polymeric material.
Figure 5:
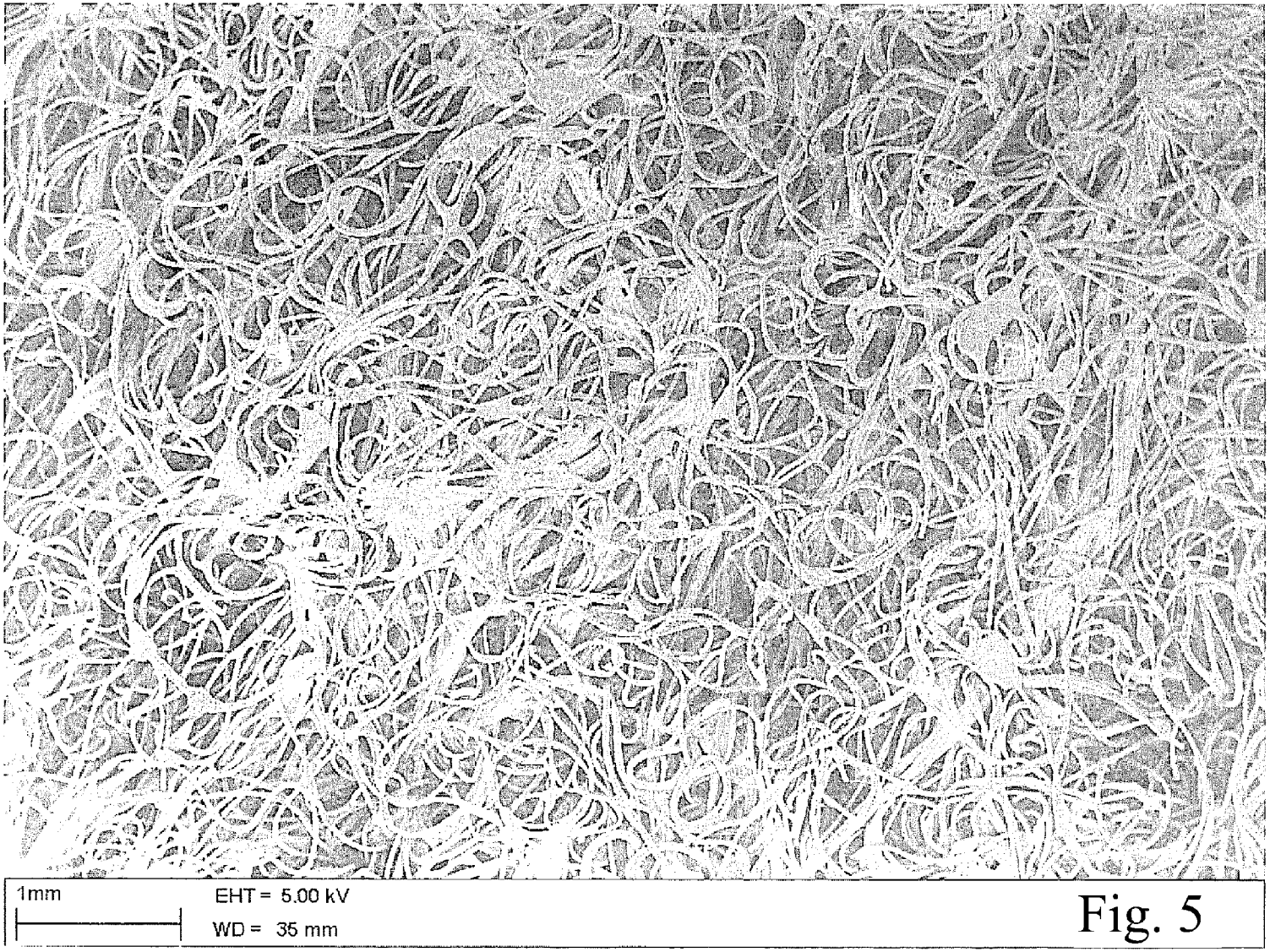
FIG. 5 illustrates an additional electron-microscopical micrographie of the web material contact side with a permeable composite structure, consisting of fibers and polymeric material.

FIGS. 4 and 5 illustrate a top view of web material contact surface 22 of such layer 20 of polymeric material. One recognizes the fiber structure and the structure-forming polymeric material surrounding said structure, and a multitude of pores. This structure not only achieves an increased rigidity and rebound characteristic of layer 20 of fibrous material, but at the same time the micro-structuring, and possibly the surface energy of the added polymeric material on the surface, facilitate the release of a press fabric of this type at those locations where it is to be separated from the web material that is to be manufactured.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press fabric for a machine for the production of a fibrous material web, the press fabric comprising:

a carrying structure;

at least one layer of fibrous material having fibers, said fibers being configured to form hollow spaces in between said fibers;

a first polymeric material at least partially coating at least some of said fibers to form a film of said first polymeric material, said first polymeric material being in the form of an aqueous dispersion of particle shaped first polymeric material; and a second polymeric material, said fibers and said second polymeric material forming a fluid-permeable composite structure, wherein said hollow spaces are at least one of partially filled and bridged with said second polymeric material.

2. The press fabric according to claim 1, wherein said film is configured to coat at least a plurality of sections of said fibers, said film having a thickness in the range of approximately 1 μm to 20 μm.

3. The press fabric according to claim 2, wherein at least some of said fibers are bonded with each other at at least one of fiber cross points and fiber contact points through said film of said first polymeric material.

4. The press fabric according to claim 3, said permeable composite structure further comprising at least one of three-dimensional polymeric formations and two-dimensional polymeric formations which are at least partially connected.

5. The press fabric according to claim 4, wherein said at least one of three-dimensional polymeric formations and two-dimensional polymeric formations are at least partially connected and arranged irregularly relative to each other.

6. The press fabric according to claim 5, wherein said second polymeric material one of at least partially fills and bridges said hollow spaces and is deposited on said plurality of sections of fibers being coated with said film of said first polymeric material.

7. The press fabric according to claim 6, wherein said second polymeric material one of completely fills and bridges said hollow spaces and is deposited on said sections of fibers being coated with said first polymeric material forming said film.

8. The press fabric according to claim 7, wherein said first polymeric material and said second polymeric material include an elastomer polymer.

9. The press fabric according to claim 8, wherein said first polymeric material and said second polymeric material are an elastomer polymer.

10. The press fabric according to claim 9, wherein said elastomer polymer is an elastomer polyurethane.

11. The press fabric according to claim 9, wherein said second polymeric material comprises a thermoplastic elastomer.

12. The press fabric according to claim 11, wherein said thermoplastic elastomer includes at least one of a thermoplastic elastomer polyurethane, a polyether mass polyamide and a polyamide (PA).

13. The press fabric according to claim 12, wherein said polyamide (PA) is one of PA 11, PA 12, PA 6.10 and PA 6.12.

14. The press fabric according to claim 13, wherein said second polymeric material is one of a thermoplastic elastomer polyurethane, a polyether mass polyamide and a polyamide (PA).

15. The press fabric according to claim 14, wherein at least part of said fibers are coated with a plurality of film layers of said first polymeric material.

16. The press fabric according to claim 15, wherein said plurality of film layers each have different properties.

17. The press fabric according to claim 16, wherein said at least one layer of fibrous material includes an outer fibrous layer including said first polymeric material and said second polymeric material, said outer fibrous layer providing a web material contact side of the press fabric.

18. The press fabric according to claim 17, wherein said first polymeric material extends to a depth of approximately 10% to 100% of an overall thickness of the press fabric when viewed from said web material contact side.

19. The press fabric according to claim 18, wherein said first polymeric material extends to a depth of approximately 30% to 100% of an overall thickness of the press fabric when viewed from said web material contact side.

20. The press fabric according to claim 19, wherein said first polymeric material extends to a depth of approximately 50% to 100% of an overall thickness of the press fabric when viewed from said web material contact side.

21. The press fabric according to claim 20, wherein said second polymeric material extends to a depth of approximately 10% to 50% of said overall thickness of the press fabric when viewed from said web material contact side.

22. The press fabric according to claim 21, wherein said second polymeric material extends to a depth of approximately 10% to 30% of said overall thickness of the press fabric when viewed from said web material contact side.

23. The press fabric according to claim 22, wherein 80% of said second polymeric material is arranged over 80% of said overall thickness of the press fabric.

24. The press fabric according to claim 22, wherein 80% of said second polymeric material is arranged over 40% of said overall thickness of the press fabric.

25. The press fabric according to claim 21, wherein said second polymeric material is one of fluid permeable and fluid impermeable.

26. The press fabric according to claim 25, wherein said first polymeric material has a higher melting point than said second polymeric material.

* * * * *